United States Patent [19]

Dooling

[11] Patent Number: 4,519,293

[45] Date of Patent: May 28, 1985

[54] OIL WELL JACK

[76] Inventor: Joe E. Dooling, 1101 Rio Brazos, Aztec, N. Mex. 87410

[21] Appl. No.: 507,286

[22] Filed: Jun. 23, 1983

[51] Int. Cl.[3] ..... F01L 31/02; F01B 1/00

[52] U.S. Cl. ..... 91/178; 91/186; 91/279; 91/346; 251/75

[58] Field of Search ..... 91/346, 347, 218, 178, 91/186, 279; 251/75

[56] References Cited

U.S. PATENT DOCUMENTS 3,128,675 4/1964 Dulaney ..... 91/178

3,167,083 1/1965 Nickell ..... 91/346

3,971,213 7/1976 Kelly ..... 91/218

4,201,115 5/1980 Ogles ..... 91/218

*Primary Examiner*—Paul E. Maslousky

*Attorney, Agent, or Firm*—Donald P. Smith

[57] ABSTRACT

The invention relates to an oil well jack having a walking beam mounted on a frame for motion in a vertical plane; and a plurality of hydraulic actuators connected to move the walking beam. The amplitude of movement of the beam as well as the frequency of the stroke are adjustable through regulation and control of the hydraulic system.

5 Claims, 8 Drawing Figures

OIL WELL JACK

BACKGROUND OF THE INVENTION (1) Field of the Invention

The invention relates to an oil well jack which depends on hydraulic pressure applied through actuators to move a walking beam, and a high degree of amplitude and frequency control of the walking beam is provided through a novel hydraulic valve system.

(2) Description of the Prior Art

Many prior art systems for pumping oil are known, and most of them depend for operation upon a prime mover such as an internal combustion engine or an electric motor driving a walking beam through a complex series of mechanical gears. While this system may be adequate when the motion and speed of the beam is predetermined and does not change, still, if the length of beam stroke or the speed of the beam is to be changed the gears must be changed; which operation requires two or three days work by skilled jack mechanics, and results in substantial down-time of the expensive equipment and lost product production. The oil well jack to be described hereinafter offers the user a very versatile system wherein both length (amplitude) of the walking beam stroke may be changed and the speed of motion (frequency) of the beam may be changed by relatively simple adjusting means. An unexpected and unobvious result of the invention disclosed herein is the fact that a complete jack constructed according to this disclosure can be delivered to the pumping site for approximately one half the cost of the conventional gear-driven jack. It follows, then, that the reduced initial cost plus a high level of flexibility in operation has reslted in commercial success of the system.

Applicant is aware of the following prior art U.S. patents:

| | |
|---|---|
| Galbraith | 867,578 |
| Tozier | 1,233,728 |
| Junggren | 1,133,288 |
| Burgess | 3,419,246 |
| Austrian Patent | 191,565 |
| Delitsch | 1,789,353 |
| Carson | 1,806,447 |
| Freeman | 2,647,534 |
| Terry | 3,015,963 |
| French Patent | 1,335,138 |

Galbraith, Tozier, Burgess, and the Austrian Patent appear to teach that it is well known to use the pivotal movement of a lever arm to cause longitudinal movement of a valve.

Delitsch, Carson, Freeman, Terry and the French Patent show spring biased valves. Junggren shows a valve actuator moved against a biasing spring by a pivoting beam member and having a cam structure to positively close the valve in the event of prolonged open-state operation.

None of the patents discussed above appears to teach or even suggest the system as claimed in this application.

SUMMARY OF THE INVENTION

The invention relates to an oil well jack structure which is hydraulically operated and has a novel arrangement of parts to accurately control motion of the walking beam thereby sharply reducing the initial cost of the structure and providing flexible and adjustable operation thereof.

It is a broad object of the invention to provide a hydraulically operated oil well jack.

It is yet another object of the invention to provide a hydraulically actuated oil well jack having a valve to direct the application of pressure to respective actuators, and a valve control system which feeds back motion of a walking beam to the system.

It is a further object of the invention to provide a valve controlling device wherein an over-center cam assembly operates against tension springs, and a degree of freedom of motion is provided in a housing which results in positive and accurate valve control.

BRIEF DESCRIPTION OF THE DRAWINGS

A detailed description of the invention will be made with reference to the accompanying drawings wherein like reference characters designate like or corresponding parts in the several figures.

DESCRIPTION OF THE PREFERRED EMBODIMENT

Figures 1, 2:
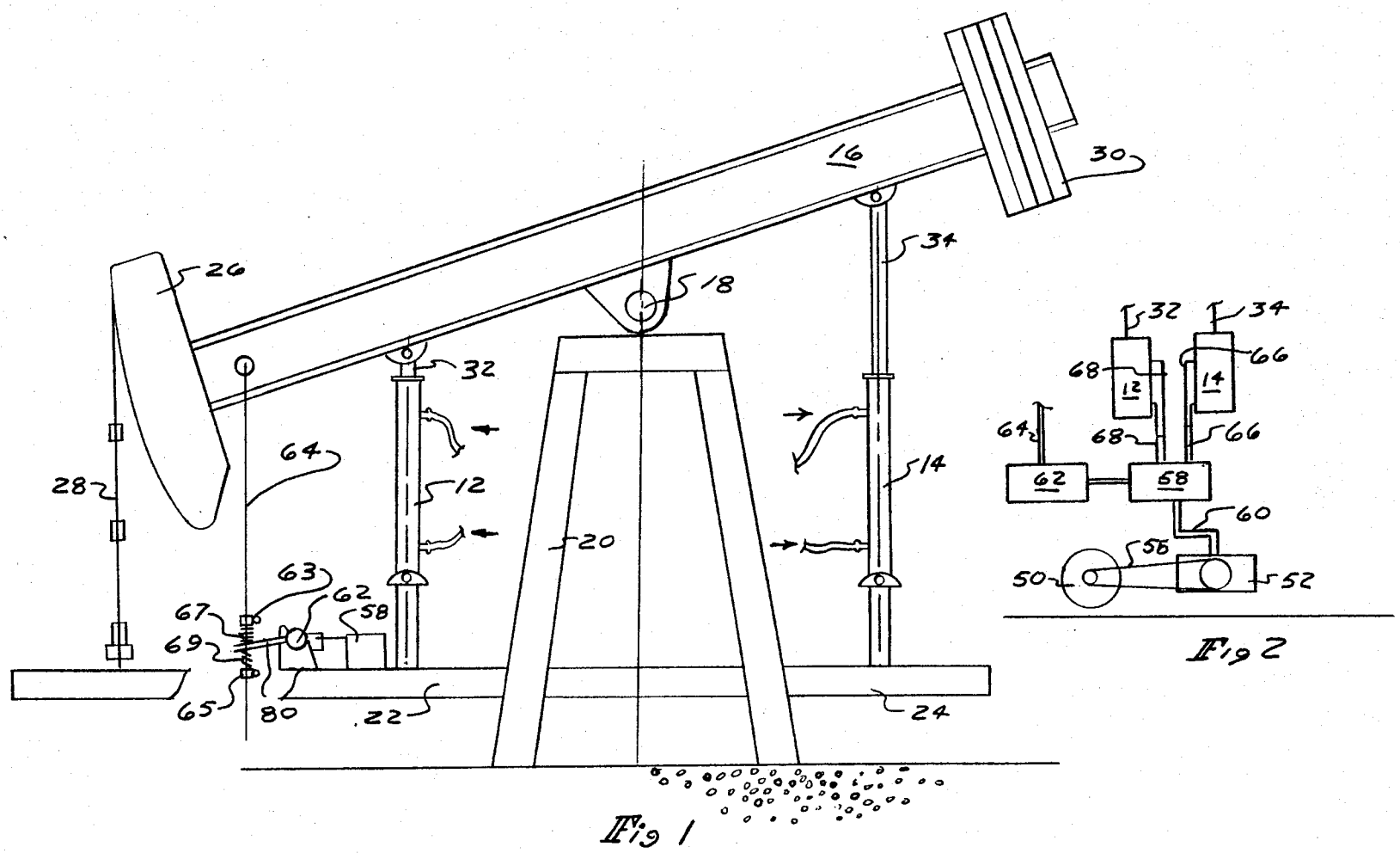
FIG. 1 is an elevation view of the oil well jack system according to the invention.
FIG. 2 is a schematic representation of the hydraulic system of FIG. 1.

The following detailed description is of the best method, and structure, and mode of carrying out the invention. The description is not to be taken in a limiting sense, but is made for the purpose of illustrating the general principles of the invention. The scope of the invention is defined by the appended claims.

Referring now to the drawings, reference character 20 designates a frame to support the working parts of the oil well jack forming part of this invention. Reference character 16 indicates a walking beam pivoted on frame 20 at 18. Hydraulic piston actuators 12 and 14 are connected between members 22 and 24 and the walking beam substantially as shown, and have connecting rods 32 and 34 extending therefrom and pivotally connected to walking beam 16. A head 26 is secured to one end of the walking beam 16 and has a bridle 28 depending therefrom and extending down into the well. Counterweights 30 serve to balance the weight of the head 26 and the weight of the structure extending into the well. A valve 58 is used to control the application of hydraulic pressure to respective ones of piston actuators 12 and 14 in turn, and valve controller 62, connected to walking beam 16 by shaft 64 monitors the action of valve 58, as will later be more fully explained. Arm 80 extends between controller 62 and shaft 64 and has compression springs 67 and 69 fixed in sandwich relation to the end of arm 80. Stops 63 and 65 are movably adjustable on shaft 64 for a purpose to be later described.

FIG. 2 designates the schematic hydraulic system wherein an electric motor 50 has a belt 56 connected to pump 52 and has hydraulic line 60 extending between pump 52 and valve 58. Valve 58 regulates the application of hydraulic pressure in turn to respective ones of actuators 12 and 14 through hydraulic lines 68 and 66 and mechanical shaft 64 connected between walking beam 16 and valve controller 62 regulates valve action which, in turn, regulates hydraulic power to the walking beam actuators.

Figure 3:
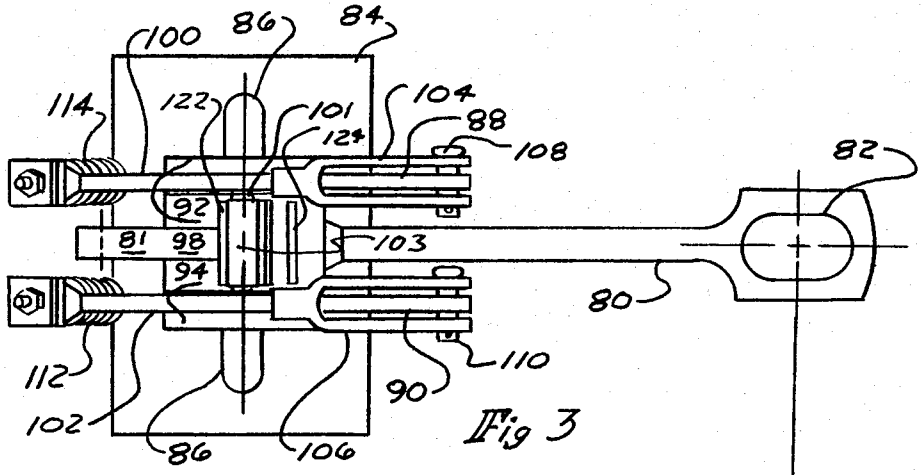
FIG. 3 is a plan view of the valve controller used in the systems of FIGS. 1 and 2.
Figure 5:
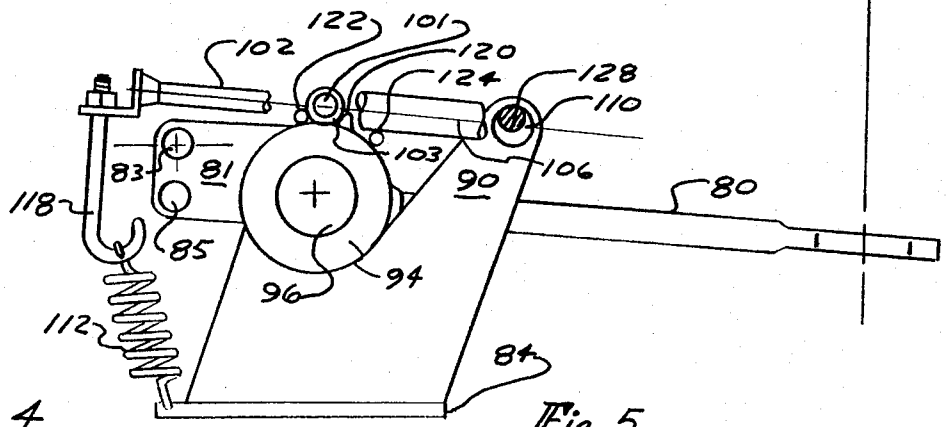
FIG. 5 is an elevation view of the structure of FIGS. 3 and 4.
Figure 4:
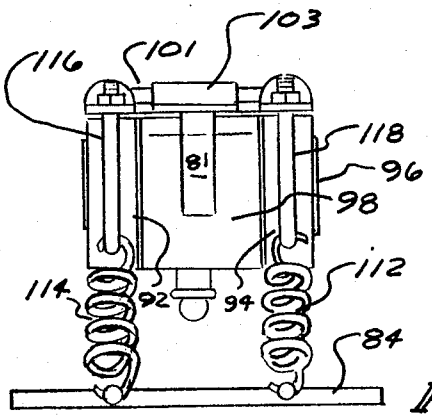
FIG. 4 is an end view of the structure of FIG. 3.

FIG. 3 show the details of valve controller 62. Here a base, reference character 84 having mounting holes 86 pierced there through supports ears 88 and 90 in space vertical planes. Each ear carries a perforated anulus 92 and 94 at its midpoint. A shaft 96 penetrates each annulus and extends therebetween. A third annulus 98 is mounted for rotation on shaft 96 and is arranged in sandwich relation to annuli 92 and 94. A boss 120 is formed on the upper surface of annulus 98 and stops 122 and 124 are affixed on each side of the boss. An outwardly radiating arm 80 is connected to annulus 98 and has an aperture 82 formed therein to receive connecting rod 64 from the walking beam. A flange 81 is joined to the other side of annulus 98 and has apertures 83 and 85 formed therein to receive a connecting rod (not shown) to join to valve 58. A pair of rods 100 and 102 extend toward each respective ear 88 and 90 and terminate in clevises 104 and 106. Another rod 101 connects between rods 100 and 102 and carries cam rider 103. Pins 108 and 110 join respective clevises to their respective ears. The other end of rods 100 and 102 terminate in hook members 116 and 118 which in turn are connected to tension springs 112 and 114 which have their other ends joined to base 84. It should be noted that aperture 128 formed in ear 90 is of substantial greater diameter than the pin 110 which penetrates it. Similarly, aperture in ear 88 is also of substantially greater diameter than the pin 108 which pierces it. The reason for this mechanical tolerance and degree of freedom will later be explained.

OPERATION

In the oil pumping arts, to which this invention is directed, conditions in the well are almost never constant and fluctuate with the flow of oil to the pumping area and, sometimes a flow of water to the same pumping area. In practice it is desirable, for an efficient operation, when water is flowing to the pumping area to pump rapidly and with relatively short walking beam strokes to agitate the oil-water emulsion to drain the emulsion. After the water is out, the beam may then return to its normal pumping frequency and stroke. In the schematic diagram of the hydraulic system of FIG. 2 the hydraulic pressure from pump 52 through valve 58 is applied simultaneously to the top intake port of actuator 12 and bottom intake port of actuator 14 thus forcing walking beam 16 in a counterclockwise direction. Motion of connecting rod 64 feeds back the walking beam position to valve 58 which now simultaneously applies hydraulic pressure to the bottom intake port of actuator 12 and the top intake port of actuator 14 thereby arresting the momentum of the walking beam and forcing it to move in a clockwise direction. This cycle repeats and is continuous. The hydraulic pressure from pump 52 is substantially constant but, by using a by-pass valve (not shown) the pressure applied to the several actuators 12 and 14 can be changed at will thus varying the force on the pistons and the frequency of the cycle of walking beam 16 with respect to time. In actual practice, frequency of operation of the walking beam can be varied in this system from 3 to 10 cycles per minute by adjusting the by-pass valve.

Figure 6:
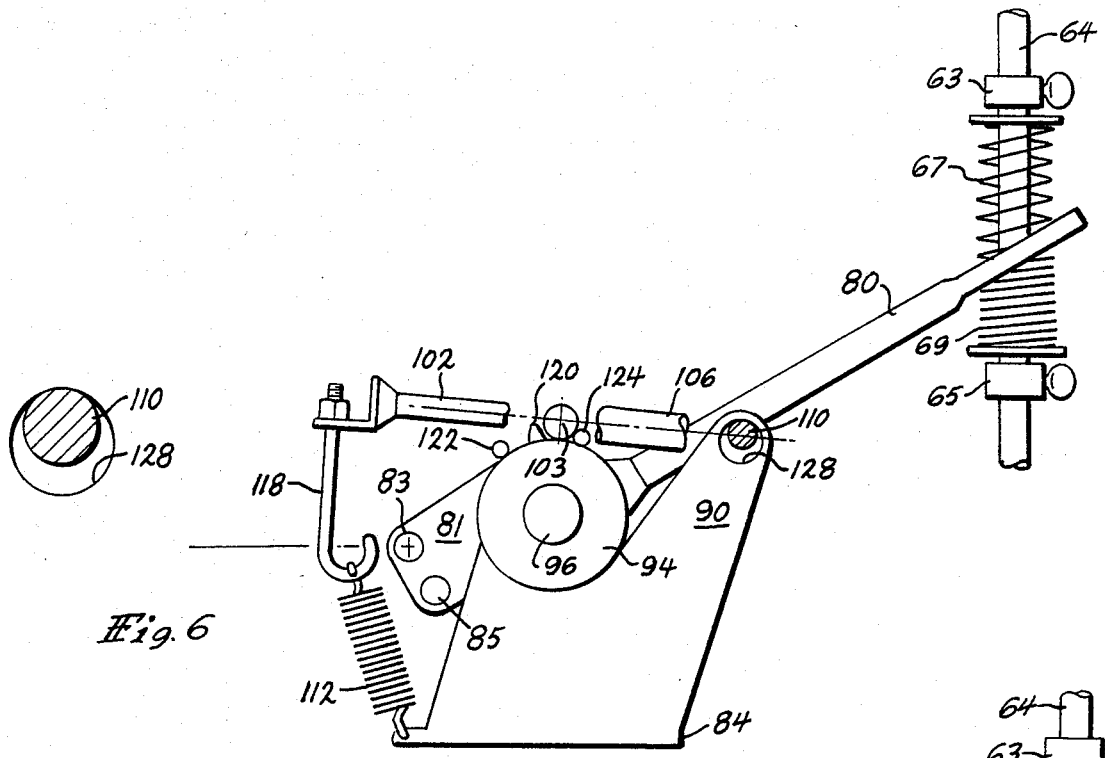
FIG. 6 is an elevation view of the valve controller when the walking beam is in the full upward position.
Figure 7:
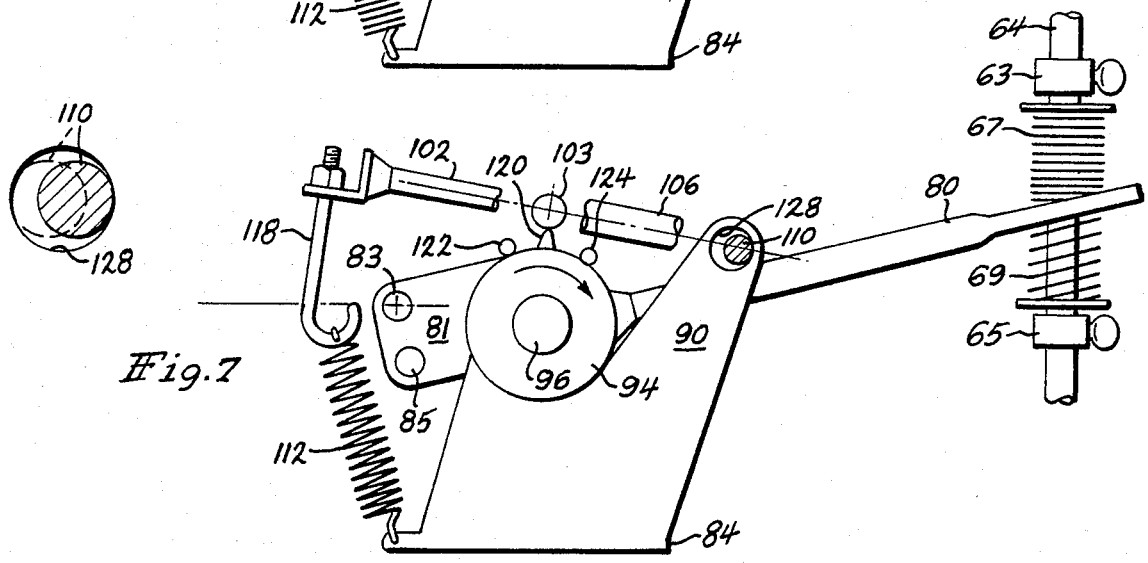
FIG. 7 is an elevation view of the valve controller when the walking beam moves in its downward stroke.
Figure 8:
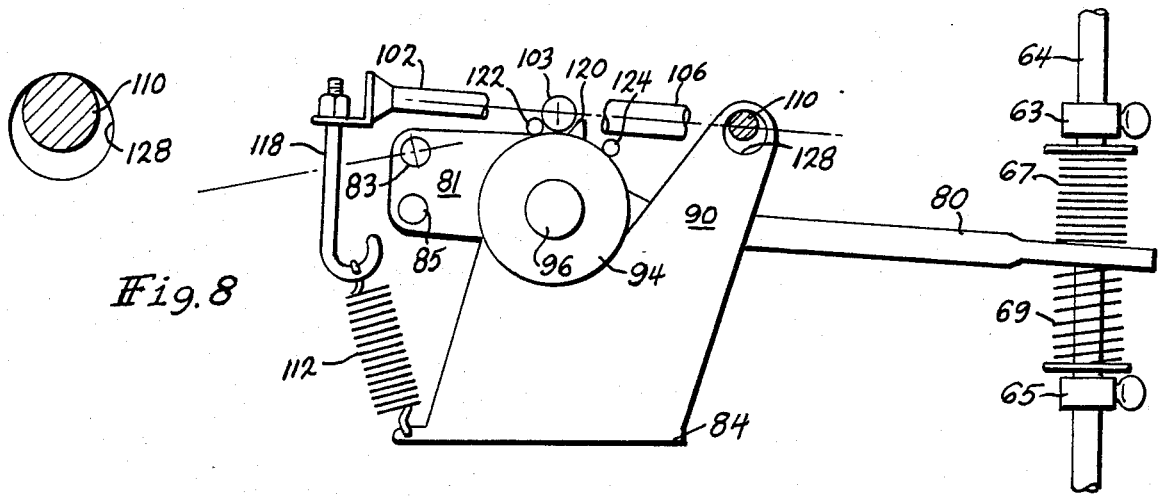
FIG. 8 is an elevation view of the valve controller when the walking beam is in the full downward position.

The operation of valve controller 62 and the method of adjusting the length or amplitude of the stroke of walking beam 16 will now be described. With the walking beam 16 on the downward stroke and valve 58 supplying hydraulic pressure to the bottom intake port of actuator 14 and the top intake port of actuator 12 the beam will rotate counterclockwise. As stop 63 engages spring 67, the spring will be compressed (FIG. 7) thus applying force to arm 80. Pins 110 and 108 move to the 3 o'clock position in the aperture 128 and rider 103 reaches the peak of cam 120 as the downward force continues. Rider 103 snaps into its rest position between cam 120 and stop 122 and pins 110 and 108 swing back to the 12 o'clock position. This results in arcuate motion of flange 81 which is connected to valve 58, thus changing the hydraulic force applied to actuators 12 and 14 and reversing the cycle. With hydraulic force applied to the top inlet port of actuator 14 and the bottom inlet port of inlet 12 the walking beam will rotate clockwise. Stop 65 compresses spring 69 until force on arm 80 urges pins 110 and 108 to the 9 o'clock position. Rider 103 reaches the peak of cam 120 as upward force continues. Rider 103 then snaps into its rest position between cam 120 and stop 124 (FIG. 6) and pins 110 and 108 return to the twelve o'clock position. Thus, pins 110 and 108 swing through an arc of 180 degrees in their apertures during a full cycle of operation of the walking beam. Adjustable stops 63 and 65 can be moved to any position on connecting rod 64 to vary the amplitude of the stroke of walking beam 16.

An efficient and flexible system has been shown above and while the invention has been shown and described in detail in the drawings and specification, it will be apparent to those skilled in the art that many changes may be made in the construction and arrangement of parts without departing from the scope of the invention as defined in the appended claims.

I claim:

1. An oil well jack comprising in combination:
   (a) A walking beam pivotally mounted on a frame for motion in a vertical plane,
   (b) a plurality of hydraulic actuators connected between the frame and the walking beam, one on each respective side of the pivot point,
   (c) a source of hydraulic fluid under pressure,
   (d) a valve to direct the application of hydraulic pressure to the respective actuators in alternate sequence,
   (e) an operating mechanism for said valve connected between said walking beam and said valve to control timed valve action comprising a housing, an arm pivtally mounted in said housing, a boss on said arm, means connecting said arm to said walking beam, means connecting said arm to said valve, over center means mounted on said housing to be engaged by said boss, resilient means normally urging said over center means against said boss, and a plurality of pins penetrating the housing and said resilient means each having a loose fit and arranged to move in a semi-circle during motion of said arm in a complete cycle.

2. In an operating mechanism for a valve of an oil well jack the combination comprising:

(a) a frame having a pair of uprightly extending ears in spaced vertical planes, each ear supporting a perforated annulus at its midpoint, (b) A shaft penetrating each annulus and extending therebetween, (c) a third annulus mounted for rotation on said shaft in sandwich relation to the said first recited annuli, (d) a boss on the upper surface of said third annulus, (e) an outwardly radiating arm connected to said third annulus for connection to the oil well jack, (f) a flange connected to the said third annulus displaced 180 degrees from said arm for connection to the oil well jack valve, (g) a pair of members each joined at one end to the upper ends of said ears by a pin penetrating its respective ear and extending over said first recited annuli, (h) a roller joining said members for engagement by said boss, and (i) a pair of downward extending legs resiliently connected between respective ones of said members and said frame.

3. The invention according to claim 1 wherein each respective pin penetrating its respective ear has a loose fit in its aperture and provides freedom for motion of the said members with respect to the ears during pivotal motion of said arm.

4. The invention according to claim 5 wherein each respective pin rests in the 12 o'clock position in its aperture when the said arm is in the full upward position, upon downward arm motion each pin moves to the 3 o'clock position, and upon full down position each pin returns to the 12 o'clock position.

5. The invention according to claim 4 wherein each respective pin rests in the 12 o'clock position in its aperture in the full down position of said arm, upon upward arm motion pin moves to the 9 o'clock position and upon return to the full up position each pin rests in the 12 o'clock position.

* * * * *